US005407418A

United States Patent [19]

Szpur

[11] Patent Number: 5,407,418

[45] Date of Patent: Apr. 18, 1995

[54] PULSATING COMPRESSOR APPARATUS FOR ENHANCING BLOOD FLOW

[76] Inventor: Roman Szpur, 4366 Sillman Pl., Kettering, Ohio 45440

[21] Appl. No.: 135,978

[22] Filed: Oct. 14, 1993

[51] Int. Cl.[6] ..... A61H 7/00

[52] U.S. Cl. ..... 601/104; 601/152; 601/29; 601/101

[58] Field of Search ..... 601/134, 107, 108, 104, 601/27, 29, 30, 31, 41, 5, 133, 152, 84, 97, 101

[56] References Cited

U.S. PATENT DOCUMENTS

| | | | |
|---|---|---|---|
| 1,546,506 | 7/1925 | Naysmith | 601/27 |
| 2,255,066 | 9/1941 | Lamb | 601/29 |
| 2,836,174 | 5/1958 | Infanger | 601/27 |
| 2,869,158 | 1/1959 | Sivells | 601/97 |
| 3,374,783 | 12/1965 | Hurvitz | 601/41 |
| 4,991,568 | 2/1991 | Lin | 601/101 |

*Primary Examiner*—Robert A. Hafer

*Assistant Examiner*—David J. Kenealy

*Attorney, Agent, or Firm*—Jacox & Meckstroth

[57] ABSTRACT

A non-stretchable flexible band is wrapped around the arch of a foot and has end portions connected by an adjustable fastener. The bottom portion of the band is attached to a compressor hinge and carries a rigid arcuate pad on which is releasably mounted a replaceable resilient pad. The compressor hinge is connected to a flexible cable and a surrounding sheath which are removably coupled to a power drive unit. The power drive unit reciprocates the cable within the sheath and pivots the compressor hinge between a collapsed position and an extended position where the pads are compressed against a localized region on the bottom of the foot. The drive unit includes an electric motor which is momentarily energized and controlled by a timer module to reciprocate a spring bias rack connected to reciprocate the flexible cable.

17 Claims, 2 Drawing Sheets

PULSATING COMPRESSOR APPARATUS FOR ENHANCING BLOOD FLOW

BACKGROUND OF THE INVENTION

In order to enhance circulation of blood in a person's body, and particularly, in the feet and legs, hands and arms, it is known that periodic or cyclic compression of plexus regions of the foot or hand at predetermined timed intervals is beneficial. For example, U.S. Pat. Nos. RE 32,939 and RE 32,940 both disclose an air inflatable bag which is placed under the arch of the foot and is attached to the foot by wrapping the bag or bag material around the foot and securing the bag material together with one or more Velcro fasteners. When the bag is inflated, the bag squeezes the plantar-arch region of the foot and compresses the adjacent blood vessels for increasing the flow velocity of blood within the vessels. The enhanced circulation of the blood can help reduce swelling and pain and can also help prevent potential complications during recovery from surgery.

It has been found desirable to concentrate the compression force against the bottom of the foot or hand in a specific area or plexus region where there is a high concentration of blood vessels in order to obtain the maximum increase in circulation of the blood through the vessels. Such a concentrated force does not occur with an air bag adjacent the foot since the pressurized air produces a uniform pressure over the entire area of the bag. Thus a relative high air pressure is required in the bag in order to produce the force desired on a localized region. It has also been determined that there is a problem in preventing the rupturing of an air bag at a seam, especially with the higher air pressure within the bag.

SUMMARY OF THE INVENTION

The present invention is directed to improved pulsating compressor apparatus for stimulating or enhancing blood flow within vessels and which is particularly suited for use on a person's foot or hand for periodically applying a concentrated force against a localized plexus region of the foot or hand. The pulsating compressor apparatus of the invention is also dependable in operation, is convenient to use and may be easily adjusted for selecting the time period during which the compressing force is applied as well as for selecting the time interval between applications of the compressing force.

In accordance with a preferred embodiment of the invention, a movable compressor hinge is attached to the center portion of a flexible band which is adapted to encircle the foot adjacent the arch. The compressor hinge engages an arcuate pad and is movable between a retracted or relaxed position and extended or pressing position for compressing the pad against the bottom of the foot. A motor drive unit includes an output member which reciprocates between an extended position and a retracted position in response to rotation of the motor shaft. An elongated flexible cable within a surrounding flexible sheath is connected to the compressor hinge and is releasably connected to the output member of the drive unit. The cable moves the compressor hinge between its relaxed and pressing positions in response to linear movement of the output member between its retracted and extended positions.

Other features and advantages of the invention will be apparent from the following description, the accompanying drawings and the appended claims.

DESCRIPTION OF THE PREFERRED EMBODIMENT

Figure 1:
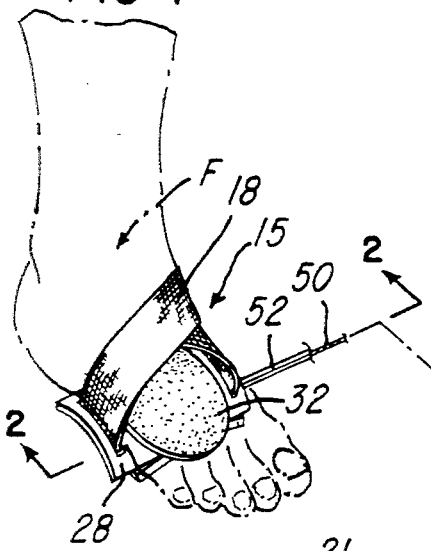
FIG. 1 is a perspective view of pulsating compressor apparatus constructed in accordance with the invention and illustrating the attachment of the compressor to a person's foot.
Figure 1:
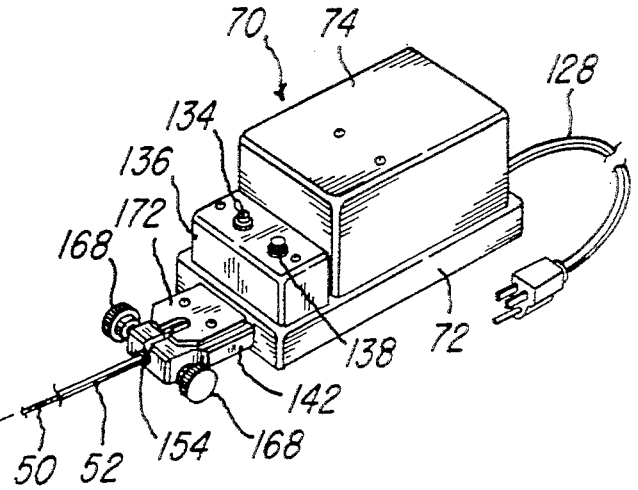
Figure 5:
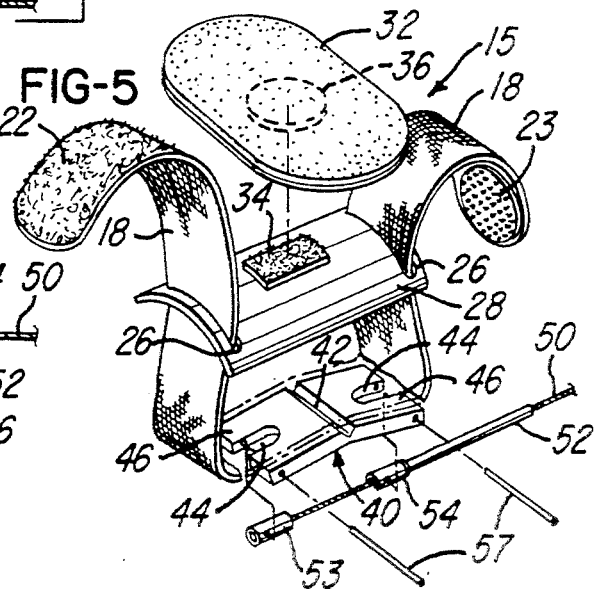
FIG. 5 is an exploded perspective view of the compressor shown in FIGS. 1–4.

Referring to FIG. 1, a compressor 15 is shown mounted on a foot F and includes a flexible non-elastic band 18 which wraps around the foot and includes opposite end portions connected on top of the foot by an adjustable Velcro fastener 21 having a fabric loop portion 22 (FIG. 5) and a fabric hook portion 23. The band 18 extends through slots 26 within opposite end portions of a rigid part-cylindrical or arcuate compressor pad or member 28 preferably molded of a rigid plastics material. A flexible and resilient oval pad 32 is removably attached to the top of the compressor pad 28 by a releasable Velcro Fastener including a patch 34 of fabric loops and a patch 36 of fabric hooks.

The compressor 15 also includes a pivotal hinge 40 which is formed of a plastics material such as polypropylene and includes an integrally molded flexible web 42 which forms the pivot or hinge axis. The compressor hinge 40 is attached by stiches or clamps (not shown) to the bottom portion of the band 18, and U-shaped recesses or notches 44 (FIG. 5) are formed within the pivotally connected leg portions 46 of the hinge.

A flexible metal cable 50 is surrounded by a Teflon sleeve which is enclosed within a flexible casing or helically wound metal sheath 52 surrounded by a vinyl tube. The corresponding end portions of the cable 50 and sheath 52 are secured to tubular metal fittings 53 and 54 which project into the notches 44 of the compressor hinge 40. A pair of cross pins 57 extend through corresponding aligned cross holes within the fittings 53 and 54 and leg portions 46 so that the fittings are pivotally connected to the slightly angled leg portions 46.

Figure 2:
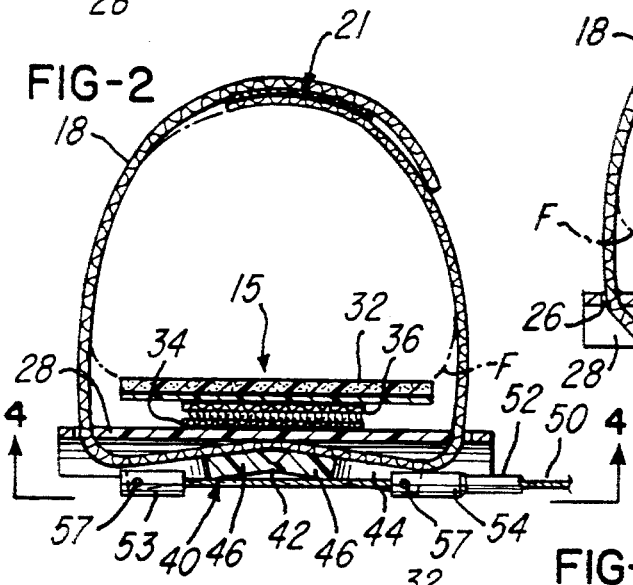
FIG. 2 is a vertical section of the compressor taken generally on the line 2—2 of FIG. I and shown in its retracted or relaxed position.
Figure 3:
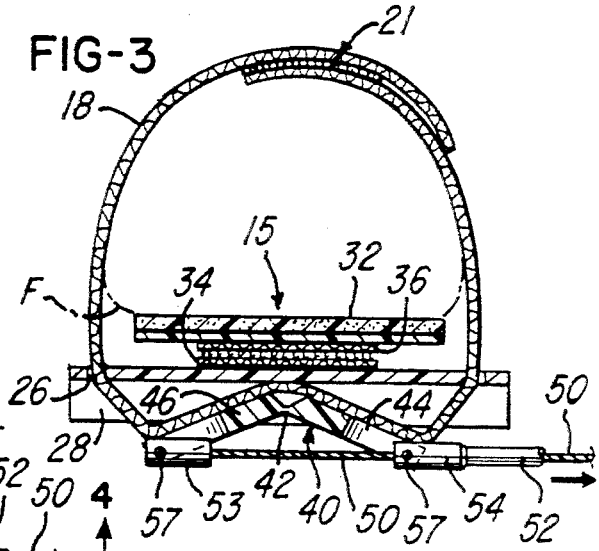
FIG. 3 is a vertical section similar to FIG. 2 and illustrating the compressor in its extended or compressing position.
Figure 4:
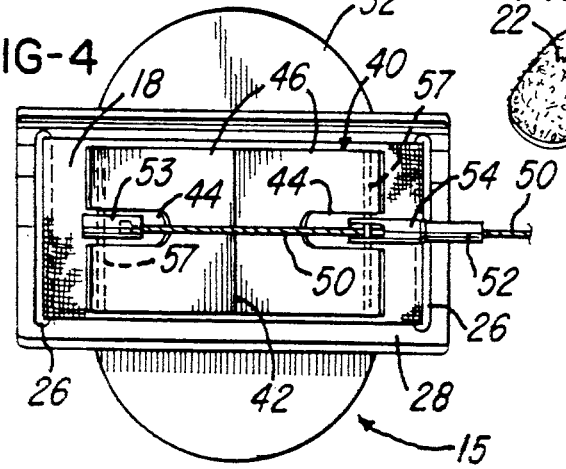
FIG. 4 is a bottom view of the compressor, taken generally on the line 4—4 of FIG. 2.

As shown in FIGS. 2 and 3, the compressor 15 is movable between a relaxed position (FIG. 2) and a compressing position (FIG. 3) in response to movement of the cable 50 within the sheath 52. That is, when the cable 50 is retracted within the sheath 52 the compressor hinge 40 moves from its relaxed position with a slightly inverted V-shaped configuration to its compressing position (FIG. 3) with a greater inverted V-shaped configuration. As the hinge 40 moves to its compressing position (FIG. 3), the hinge presses upwardly on the rigid arcuate pad 28 and resilient pad 32. This compresses a localized region within the bottom of the foot for squeezing the vessels and producing blood flow within the vessels. The upward force produced on the foot by the pivoting hinge 40 and the pad 28 is concentrated along a narrow band which extends laterally across the bottom of the foot, and the resilient pad 32 distributes the force in a tapering manner from the band. This relatively concentrated force in the plexus region of the foot produces the enhanced circulation of the blood within the concentration of vessels in the plexus region directly under the arch of the foot.

Referring to FIGS. 6–9, the compressor 15 is operated or actuated by a power drive unit 70 which includes a housing formed by a sheet metal base 72 primarily covered by a formed sheet metal cover 74. The base 72 encloses an elongated rack 76 which is positioned directly under the top wall of the base 72 and retained by a washer 78 and a backup bearing 79 under the washer 78. Tile bearing 79 holds the rack 76 in engagement with a pinion or gear 82 which is mounted on the output shaft 83 of a gear reducer unit 84 driven by an electric motor 87 having a rotor shaft 88. The opposite end portion of the rack 76 projects into a slot 93 within an inner end portion of an actuating bar 96 which projects outwardly through a slot within the end of the base 72. A pair of cross pins 97 secure the rack 76 to the actuating bar 96, and the rack 76 and bar 96 are normally held in an outwardly extended position (FIG. 8) by a tension coil spring 102 which connects a screw 103 threaded into the rack 76 to a screw 104 secured to the base 72.

Figure 6:
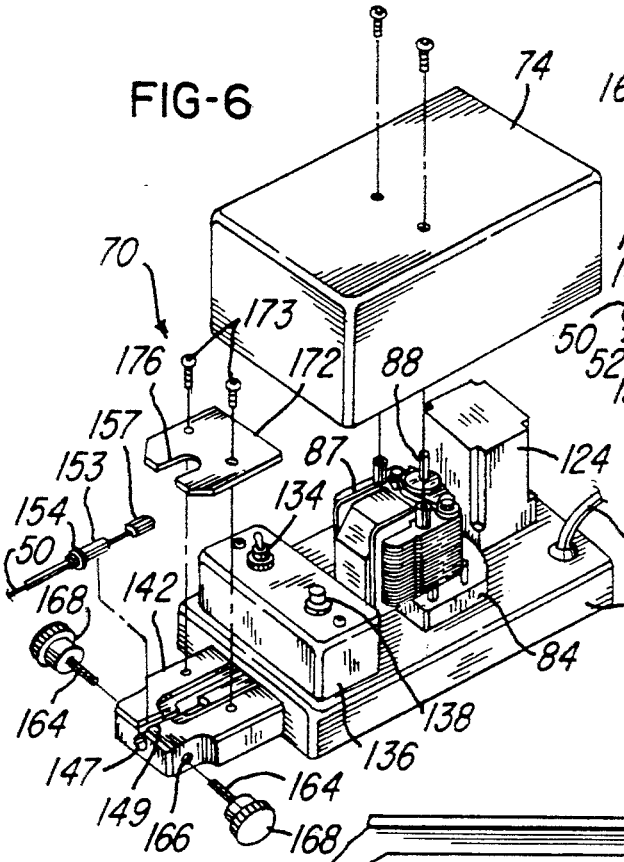
FIG. 6 is an exploded perspective view of the drive unit shown in FIG. 1 for operating the compressor.

The inner end of the actuating bar 96 has a bevel cam surface 108 which is positioned to engage a roller on an actuating lever 109 of a control switch 110 secured to the base 72 by a pair of screws 113. The switch 110 is normally on (FIG. 8) and is connected by electrical conductors 116 and 117 to terminals 118 for the motor 87 and to a socket 121 for a plug-in adjustable timer module 124 (FIG. 6). A 120 volt power supply cord 128 extends from the housing base 128 and has electrical conductors 131 which extend to a main control switch 134 supported above the base 72 and in front of the cover 74 by a formed sheet metal control box 136. An indicator light 138 is also supported by the box 136 and is wired to be illuminated whenever the switch 134 is on for energizing the control circuit.

Figure 7:
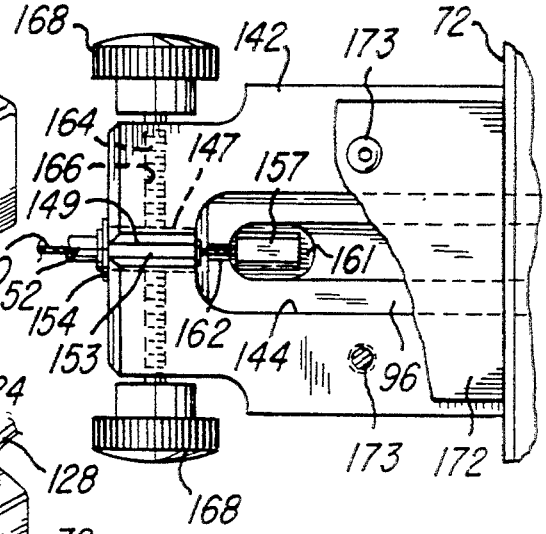
FIG. 7 is an enlarged plan view of a portion of the drive unit shown in FIG. 6 and with a portion of a cover plate broken away to show a coupling.
Figure 8:
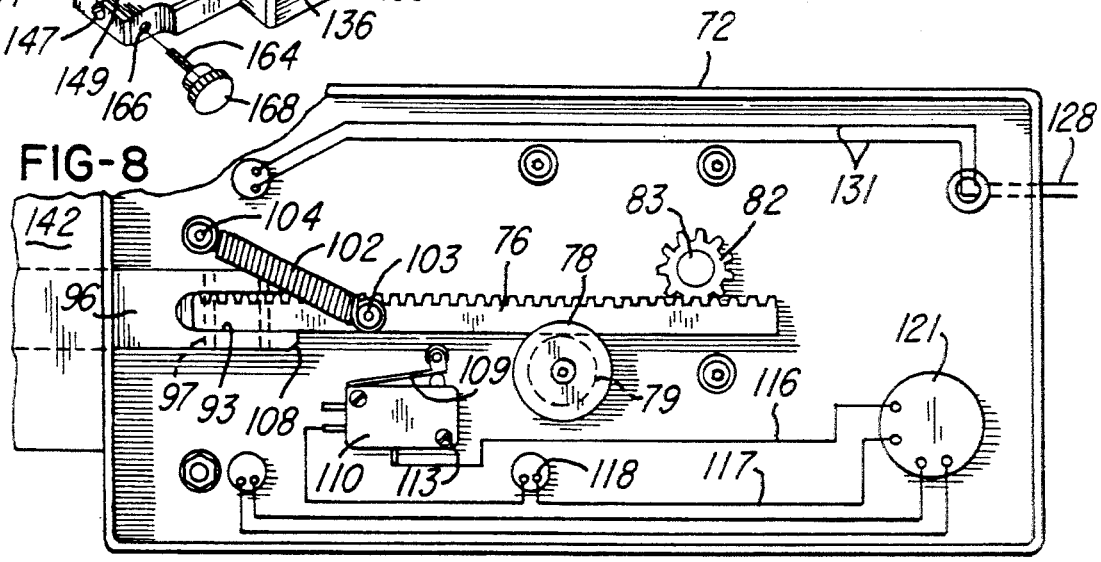
FIG. 8 is a bottom view of the drive unit shown in FIG. 6 when the compressor is in its relaxed position shown in FIG. 2.
Figure 9:
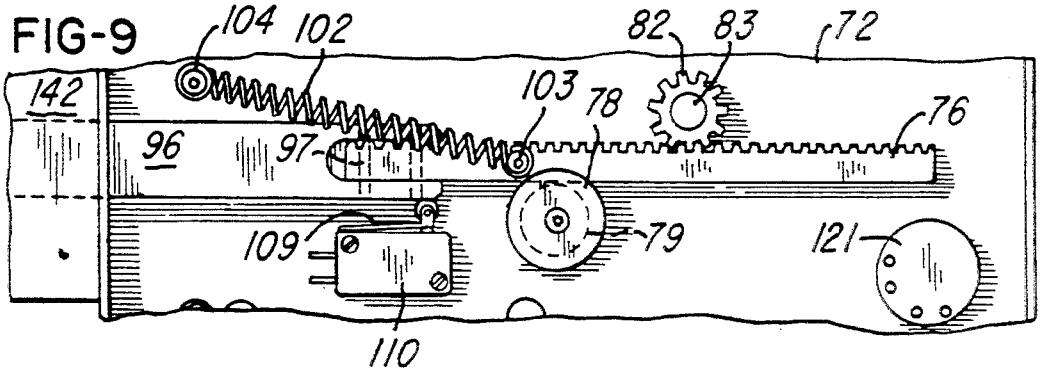
FIG. 9 is a fragmentary view similar to FIG. 8 and showing the drive unit when the compressor is in its compressing position.

A guide block 142 (FIG. 6) is secured to the forward end of the base 72 and defines a slot 144 for receiving the outer end portion of the actuator bar 96. The support block 142 also defines a cylindrical hole 147, the upper portion of which is opened by a V-shaped slot 149. The hole 147 receives a tubular metal fitting 153 which is secured to the outer end portion of the sheath 52 and has an outwardly projecting peripheral flange 154. Another tubular fitting 157 is secured to the outer end portion of the cable 50 and is received within an oval cavity 161 (FIG. 7) formed within the outer end portion of the actuator bar 96. A slot 162 extends from the cavity 161 to the end of the bar 96 for receiving a portion of the actuating cable 50. As also shown in FIG. 7, a pair of locking screws 164 extend laterally within corresponding aligned threaded holes 166 within the outer end portion of the support bar 142, and a knob 168 is secured to the outer end portion of each screw 164.

In reference to FIGS. 1 and 6, the fittings 153 and 157 on the corresponding end portions of the sheath 52 and cable 50, respectively, are removably attached to the support block 142 and actuating bar 96 by inserting the fitting 157 into the cavity 161 while the cable 50 is extended from the fitting 153. The cable 50 is then lowered through the slots 149 and 162 after which the fitting 153 is pushed axially into the hole 147. The clamping or locking screws 164 are then tightened by turning the knobs 168 to secure the fitting 154 to the support block 142. As shown in FIGS. 1 and 6, a cover plate 172 is attached to the support block 142 by a pair of screws 173, and the plate 172 has a slot 176 to permit inserting the fitting 157 into the cavity 161.

In operation of the pulsating compressor apparatus shown in FIGS. 1–9, a disposable sock is preferably placed on the foot, and the compressor 15 is attached to the foot around the sock, as illustrated in FIG. 1. The control switch 134 is then actuated to energize the light 138 and the control circuit including the timer module 124 which is adjustable between 0.6 second and 60 seconds. After a predetermined period of time, which may be selected by adjusting the timer module 124, the motor 87 is energized to rotate the rack 82 (FIG. 8) counterclockwise for retracting the rack 76 to the position shown in FIG. 9. This linear movement of the rack 76 and the actuating bar 96 pulls the cable 50 within the sheath 52 and moves the compressor 15 from its relaxed position (FIG. 2) to its compressing position (FIG. 3) when the motor 87 stalls.

When the rack 76 and actuating bar 96 are retracted, the control switch 110 is actuated to signal the control circuit and timer module 124 that the compressor 15 is in its compressing position (FIG. 3). After a selected period of time, for example, $3\frac{1}{2}$ seconds, the timer module 124 de-energizes the motor 87, and the spring 102 returns the rack 76 and actuating bar 96 to their normal positions (FIG. 8) so that the actuator 15 returns to its relaxed position (FIG. 2) for releasing the compression force against the bottom of the foot. After another period of time, for example, 20 seconds, the motor 87 is again energized by the timer module 124 for repeating the cycle and again compressing the bottom region of the foot overlying the pad 28.

From the drawings and the above description, it is apparent that pulsating compressor apparatus constructed in accordance with the present invention, provides desirable features and advantages. For example, the mechanical compressor 15 provides for concentrating the force applied to the bottom of the foot or the palm of the hand against a selected area or plexus region in order to provide effective compression of the adjacent vessels to enhance blood circulation. The compressor 15 is also dependable in operation and may be easily attached to the foot or hand with the adjustable fastener 21 in order to obtain the desired compression of the plexus region.

As another feature, the power drive unit 70 and the connecting cable 50 and sheath 52 assembly provide for obtaining a substantial force on the cable 50 relative to the sheath 52 in order to obtain substantial compression force against the bottom of the foot. The actuation of the hinge 40 with the cable 50 and sheath 52, also provides for increasing the compression force as the resistance by the foot increases. This increase is caused by the leg portions 46 of the hinge 40 being pulled closer together to obtain a mechanical advantage which amplifies the upward force produced by the hinge. The retraction of the cable 50 with the rack 76 and the motor driven pinion 82 further provides for obtaining substantial pulling force with the cable 50 to produce flexing of the hinge 40 and corresponding compression of the plexus region.

Another feature is provided by the timer module 124 and control switch 110 which provide for automatically energizing the motor 87 according to a selected cycle of operation. The attachment of the cable fitting 157 and sheath fitting 154 to the actuating bar 96 and support block 142, respectively, also provides for conveniently removing the cable and sheath assembly from the power drive unit 70, for example, when it is desired for packaging the compressor apparatus.

While the form of compressor apparatus herein described constitutes a preferred embodiment of the invention, it is to be understood that the invention is not limited to this precise form of apparatus, and that changes may be made therein without departing from the scope and spirit of the invention as defined in the appended claims.

The invention having thus been described, the following is claimed:

1. Apparatus for compressing a part of a person's body, comprising a flexible band, means for mounting said band on the body part and for encircling the body part, a compression pad connected to said band and movable between a released position and a pressing position compressing inwardly toward the body part, a compressor hinge connected to said band and having a pair of leg members with adjacent inner end portions connected by pivot means and opposite outer end portions, said compression pad being supported by said leg members for movement in response to pivoting of said leg members, a power drive unit including a support member and an output member movable between an extended position and a retracted position relative to said support member in response to operation of said unit, an elongated flexible cable extending within a flexible tubular sheath, said cable and sheath have corresponding first end portions each connected to an outer end portion of a leg member of said hinge, and said cable and sheath have corresponding second end portions connected respectively to said output member and said support member to effect movement of said compression pad between said released and pressing positions in response to pivoting of said hinge by movement of said output member between said retracted and extended positions.

2. Apparatus as defined in claim 1 wherein said compression hinge comprises a body of plastics material, and said leg members are integrally connected by a flexible web of said material forming said pivot means.

3. Apparatus as defined in claim 1 wherein said compression pad comprises a part-cylindrical rigid pad having opposite end portions with slots receiving said band.

4. Apparatus as defined in claim 3 and including a flexible and resilient pad supported by said rigid pad.

5. Apparatus as defined in claim 1 and including means supporting said output member of said power drive unit for reciprocating movement relative to said support member, said power drive unit comprising a motor having a rotary output shaft driving a pinion, an elongated rack engaging said pinion and connected to said output member, and a control switch for said motor and having actuator means responsive to movement of said rack.

6. Apparatus as defined in claim 5 and including a spring connected to said rack for returning said rack and said output member to said extended position when said motor is deactivated.

7. Apparatus as defined in claim 1 wherein said support member and said output member have aligned corresponding slots extending from corresponding cavities to provide a quick release coupling for said second end portions of said cable and sheath.

8. Apparatus as defined in claim 1 wherein said leg members of said hinge have corresponding slots receiving said first end portions of said cable and sheath, and a set of cross pins pivotally connecting said first end portions of said cable and sheath to said outer end portions of said leg members.

9. Apparatus for compressing a part of a person's body, comprising a flexible band having opposite end portions, adjustable hook and loop fastener means on said end portions of said band for mounting said band on the body part and for encircling the body part, a compression pad connected to said band and movable between a released position and a pressing position compressing inwardly toward the body part, a compressor hinge connected to said band and having a pair of leg members with adjacent inner end portions connected by pivot means and opposite outer end portions, said compression pad being supported by said leg members for movement in response to pivoting of said leg members, a power drive unit including a support member and an output member movable between an extended position and a retracted position relative to said support member, an electric motor having a rotary output shaft, means for moving said output member from said extended position to said retracted position in response to energizing said motor and rotation of said shaft, an elongated flexible cable extending within a flexible tubular sheath, said cable and sheath have corresponding first end portions each connected to a leg member of said hinge, and said cable and sheath have corresponding second end portions connected respectively to said output member and said support member to effect movement of said compression pad between said released and pressing positions in response to pivoting of said hinge by movement of said output member between said retracted and extended positions.

10. Apparatus as defined in claim 9 wherein said compression hinge comprises a body of plastics material, and said leg members are integrally connected by a flexible web of said material forming said pivot means.

11. Apparatus as defined in claim 9 wherein said compression pad comprises a part-cylindrical rigid pad having opposite end portions with slots receiving said band.

12. Apparatus as defined in claim 11 and including a flexible and resilient pad supported by said rigid pad, and hook and loop fastener means releasably attaching said resilient pad to said rigid pad.

13. Apparatus as defined in claim 9 and including means supporting said output member of said power drive unit for reciprocating movement relative to said support member, said rotary output shaft supports a pinion, and an elongated rack engaging said pinion and connected to said output member.

14. Apparatus as defined in claim 13 and including a spring connected to said rack for returning said rack and said output member to said extended position when said motor is deenergized.

15. Apparatus as defined in claim 9 wherein said support member and said output member have aligned corresponding slots extending from corresponding cavities to provide a quick release coupling for said second end portions of said cable and sheath.

16. Apparatus as defined in claim 9 wherein said leg members of said hinge have corresponding slots receiving said first end portions of said cable and sheath, and a set of cross pins pivotally connecting said first end portions of said cable and sheath to said outer end portions of said leg members.

17. Apparatus for compressing a part of a person's body, comprising a flexible band having opposite end portions, adjustable fastener means on said end portions of said band for mounting said band on the body part and for encircling the body part, a compression pad connected to said band and movable between a released position and a pressing position compressing inwardly toward the body part, a compressor hinge connected to said band and having a pair of leg members with adjacent inner end portions connected by pivot means and opposite outer end portions, said compression pad being supported by said inner portions of said leg members for movement in response to pivoting of said leg members, a power drive unit including a stationary support member and an output member movable between an extended position and a retracted position relative to said support member, an electric motor having a rotary output shaft connected to drive a pinion, an elongated rack engaging said pinion and connected to said output member for moving said output member from said extended position to said retracted position in response to energizing said motor and rotation of said shaft, an elongated flexible cable extending within a flexible tubular sheath, said cable and sheath have corresponding first end portions each pivotally connected to a leg member of said hinge, and said cable and sheath have corresponding second end portions connected respectively to said output member and said support member to effect movement of said compression pad between said released and pressing positions in response to pivoting of said hinge by movement of said output member between said retracted and extended positions.

* * * * *